US005654612A

United States Patent [19]

Kim

[11] Patent Number: 5,654,612

[45] Date of Patent: Aug. 5, 1997

[54] ELECTRON GUN ASSEMBLY ADAPTED FOR A COLOR IMAGE RECEIVING TUBE

[75] Inventor: Kyung Ho Kim, Daegu, Rep. of Korea

[73] Assignee: Orion Electric Company, Ltd., Kyungsangbuk-do, Rep. of Korea

[21] Appl. No.: 295,719

[22] PCT Filed: Dec. 28, 1993

[86] PCT No.: PCT/KR93/00118

§ 371 Date: Oct. 24, 1994

§ 102(e) Date: Oct. 24, 1994

[87] PCT Pub. No.: WO94/16457

PCT Pub. Date: Jul. 21, 1994

[30] Foreign Application Priority Data

Dec. 31, 1992 [KR] Rep. of Korea ..... 92-28105

[51] Int. Cl.[6] ..... H01J 29/50

[52] U.S. Cl. ..... 315/382.1; 313/412; 313/414; 313/439

[58] Field of Search ..... 313/412, 414, 313/416, 425, 428, 432, 439, 449, 460; 315/15, 368.15, 382, 382.1

[56] References Cited

U.S. PATENT DOCUMENTS

| | | | |
|---|---|---|---|
| 4,086,513 | 4/1978 | Evans, Jr. | 313/458 X |
| 4,208,610 | 6/1980 | Schwartz | 313/458 X |
| 4,374,342 | 2/1983 | Say | 313/414 |
| 4,772,827 | 9/1988 | Osakabe | 313/414 X |
| 4,886,999 | 12/1989 | Yamane et al. | 313/414 |
| 5,113,112 | 5/1992 | Shimoma et al. | 313/414 X |
| 5,128,586 | 7/1992 | Ashizaki et al. | 313/457 X |
| 5,218,892 | 6/1993 | Kweon et al. | 313/412 X |
| 5,291,093 | 3/1994 | Lee | 313/412 X |
| 5,300,885 | 4/1994 | Kweon | 313/449 X |

FOREIGN PATENT DOCUMENTS

| | | | |
|---|---|---|---|
| 48-23854 | 7/1973 | Japan . | |
| 52-92473 | 8/1977 | Japan . | |
| 59-139535 | 8/1984 | Japan . | |
| 0288352 | 12/1986 | Japan | 313/414 |
| 62-237641 | 10/1987 | Japan . | |

*Primary Examiner*—Ashok Patel
*Attorney, Agent, or Firm*—Pennie & Edmonds

[57] ABSTRACT

The focusing characteristic of this electron gun is not impaired by the aberration caused by the deviation from the centers of the holes on both sides of the main lens, through which the electron beams pass, and the astigmatism of the electron beams due to the uneven magnetic field such of a deflecting yoke when the electron gun is in operation. In the focusing electrode 1 of the electron gun a assembly, a plurality of focusing grooves are formed parallel to the direction in which the electron beams pass. A plurality of additional electrode members, each consisting of a flat thin plate, are inserted into the focusing grooves, respectively.

2 Claims, 2 Drawing Sheets

ELECTRON GUN ASSEMBLY ADAPTED FOR A COLOR IMAGE RECEIVING TUBE

FIELD OF THE INVENTION

This invention relates to an electron gun assembly for a color image receiving tube. Specifically, the invention relates to an electron gun assembly which prevents a lowering of the focusing characteristic of a color image receiving tube from being disturbed by aberrations caused by deviation of the centers of electron beams through holes of a main lens and by the occurrence of uneven magnetic field phenomena upon electron beams, such as deflection yoke, during the operation of the electron gun assembly.

BACKGROUND OF THE INVENTION

Generally, a color image receiving tube comprises a panel 11 on which a fluorescent film 12 is coated and a funnel 13 attached to the back of the panel 11 as shown in FIG. 1. Inside the image receiving tube, an electron gun assembly 8 emitting thermion and a shadow mask 14 distinguishing colors are installed. A deflection yoke 15 is mounted on the outer surface of the funnel 13 in order to deflect the electron beams.

The electron gun assembly 8 is comprised of a cathode electrode heated and operated by a heater, a controlling electrode, a screen electrode, a focus electrode, an anode electrode and a shield cup which are placed in series in front of the cathode electrode.

Each electrode is placed apart from each other at regular intervals and supported by bead glass in the shape of a pole or a plate. Each electrode has three electron beam passage holes.

Further, at least two electrostatic lenses are formed in the electron gun assembly; one is a pre-focus lens formed by the potential differences between the applied voltage of the screen electrode and the applied voltage of the focus electrode, and the other is a main lens formed by the potential differences between the applied voltage of the focus electrode and the applied voltage of the anode electrode. The pre-focus lens helps prevent the electron beam which emits toward the main lens from scattering, while the main lens converges the electron beam on the screen.

If the central axis of the electron beam does not impact upon the center axis of the main lens, a halo phenomena results at the beam spots on the screen and the resolution of the color image receiving tube diminishes.

FIG. 2 is a perspective view of the focus electrode used in the prior art for a electron gun assembly. In the electrode body 1, three electron beam through holes a, b and c are arranged parallel to each other at regular intervals. If both external electron beams converge on the screen under each of the electron beam through holes of the focus electrode and the anode electrodes are not in accord with each other, an aberrations occur due to the distortion of the main lens, on the electron gun assembly of the prior art when both external electron beams are passing through the main lens, thereby creating a focusing characteristic of low quality.

An object of this invention is to provide an electron gun assembly that prevents the lowering of the focusing characteristic of a color image receiving tube caused by the aberration of the electron beam which is in turn caused by deviation of the center of electron beam through holes of the main lens and by uneven magnetic field phenomena such as a deflection yoke.

DISCLOSURE OF THE INVENTION

To achieve the electron gun assembly for a color image receiving tube according to the present invention can be improved the focusing characteristic on the entire screen since the central axis of the electron beam through holes in the focus electrode is accord with the central axis of the electron beam through holes in the anode electrode. Voltage of a magnitude greater than that applied to the focus electrode is applied to additional electrode members. Such additional electrode members are arranged in parallel with and between the paths of the electron beams in the focus electrode so that the electron beam is converged accurately on the screen.

DETAILED DESCRIPTION OF THE INVENTION

An embodiment of the invention has been described with reference to the accompanying drawings.

An embodiment of the invention has been illustrated as an electron gun assembly suitable to the separation type of cathode ray tubes, however this invention can be applied to electron gun assembles of other types of cathode ray tubes as well.

Figure 1:
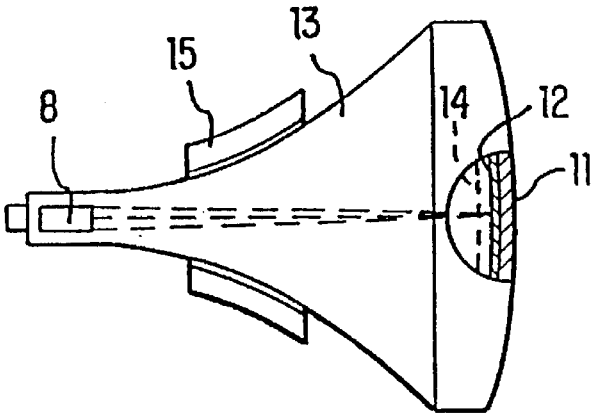
FIG. 1 (PRIOR ART)
FIG. 1 is a side view of a conventional color image receiving tube.
Figure 2:
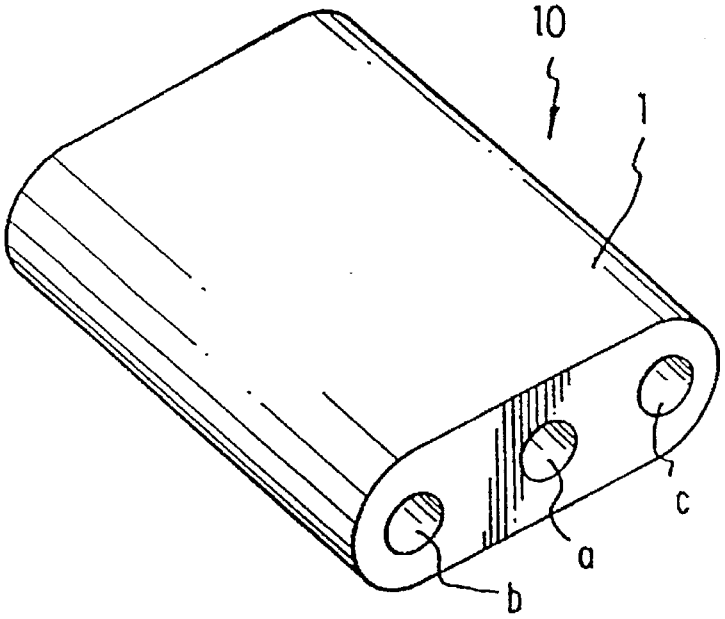
FIG. 2 (PRIOR ART)
FIG. 2 is a perspective view of a focus electrode according to the prior art.
Figure 3:
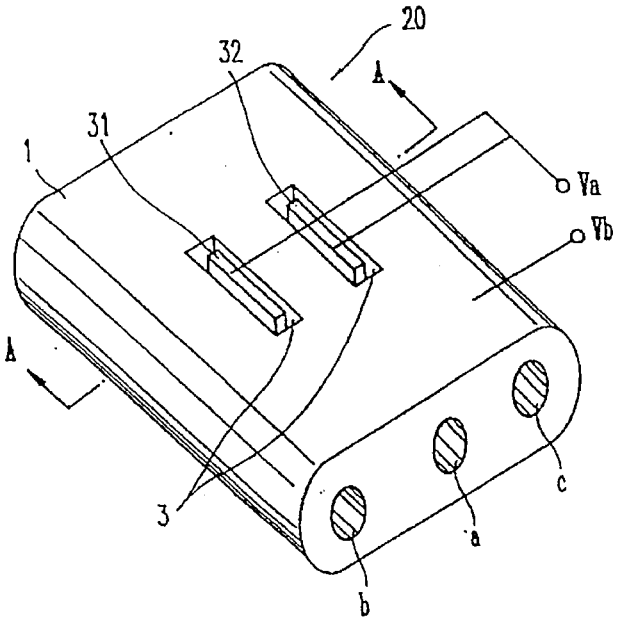
FIG. 3 is a perspective view of a focus electrode according to the present invention.

FIG. 3 shows a perspective view of the focus electrode according to the present invention. In order to enhance the focusing characteristic of the electron beam, focusing grooves 3 are formed on the focus electrode body 1 in parallel with the path of the electron beam and additional electrode members, each consisting of a flat thin plate, 31 and 32 which are inserted into the focusing grooves 3, respectively.

Two focusing grooves 3 are made on the one surface of the focus electrode body either on the upper surface, or on the lower surface. The invention is not restricted to inserting additional electrode members 31 and 32 into the focusing grooves 3, nor is it restricted to their installation in the focus electrode.

The additional electrode members 31 and 32 are preferably rectangular, thin plates of uniform length and breadth. However, they can be made in various shapes.

The voltage Va is applied to the additional electrode members 31 and 32, respectively and this voltage Va is higher than the voltage Vb applied to the focus electrode body 1.

Figure 4:
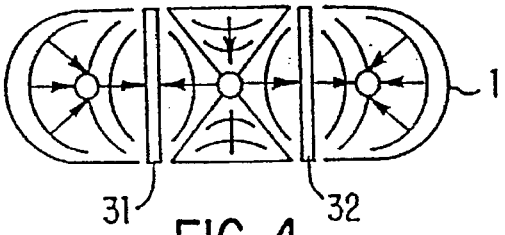
FIG. 4 shows distribution of electric field around the A—A line cross section of FIG. 3.

Accordingly, when the electron gun assembly is operated, the electron beam is affected by the electric field formed around the focus electrode as shown in FIG. 4.

The additional electrode members cause the effect at the four electrode lenses which generates the astigmatism on the electron beam. Such additional electrode members generate an electric force which causes outside electron beams to move toward the central electron beam.

Figure 5A:
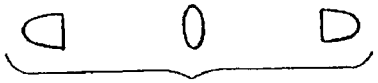
FIG. 5A (PRIOR ART)
FIG. 5A shows the cross sections of the electron beam passing through the main lens of the prior art.
Figure 5B:
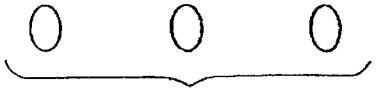
FIG. 5B shows the cross sections of the electron beam passing through the main lens of the invention.

Therefore, since both outside electron beams converge before they pass through the main lens, the cross-sectional shape of the electron beam affected by the astigmatism passing through the main lens as shown in FIG. 5B is of greater uniformity than the cross-sectional shape of the electron beam in FIG. 5A. As a result, the electron beams show less aberration.

Further, an astigmatism resulting from an uneven magnetic field such as deflecting yoke is offset by the astigmatism caused by the additional electrode members, thereby remarkably improving the focusing characteristic around the screen.

Accordingly, the application of dynamic focus voltage to the additional electrode members 31, 32, causes the focusing characteristics of the entire surface of the screen to improve remarkably thereby enabling an in-line type electron gun assembly having greater picture definition and high picture resolution.

As described above, the present invention has improved the convergence and focusing characteristics of the electron beam by means of converging electron beams before their passage through the main lens. Using plate electrodes to correct the deviational errors of the electron beam caused by deflection yokes, the present invention has enhanced the focusing characteristic of the electron gun assembly.

What is claimed is:

1. An in-line electron gun assembly adapted for a color image receiving picture tube having a plurality of electrodes, comprising:

a focus electrode body on which focusing openings are formed parallel to an electron beam path, and additional members formed as thin plates and inserted into said focusing openings, respectively, each of said additional members being supplied with a voltage which is higher than the voltage supplied to said focus electrode body.

2. A method of operating an electron gun assembly adapted for a color image receiving picture tube having a plurality of electrodes, said electron gun assembly comprising a focus electrode body and additional electrode members, said body having a plurality of electron beam through holes and a plurality of focusing openings, each of said focusing openings formed on said body parallel to a respective one of said electron beam through holes, each of said additional electrode members positioned in a respective one of said focusing openings, said method comprising the steps of:

supplying a first voltage to said focus electrode body, and supplying said additional electrode members with a second voltage which is higher than said first voltage.

* * * * *